US008534097B2

(12) United States Patent
Bae et al.

(10) Patent No.: US 8,534,097 B2
(45) Date of Patent: Sep. 17, 2013

(54) CLOTHES TREATING APPARATUS WITH LIQUID SUPPLY UNIT

(75) Inventors: Sang-Hun Bae, Gyeongsangnam-Do (KR); Sung-Ho Song, Gyeongsangnam-Do (KR); Chul-Jin Choi, Gyeongsangnam-Do (KR); Min-Ji Kim, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 58 days.

(21) Appl. No.: 13/141,639

(22) PCT Filed: Dec. 23, 2009

(86) PCT No.: PCT/KR2009/007722

§ 371 (c)(1),
(2), (4) Date: Jun. 22, 2011

(87) PCT Pub. No.: WO2010/074508

PCT Pub. Date: Jul. 1, 2010

(65) Prior Publication Data

US 2011/0252837 A1 Oct. 20, 2011

(30) Foreign Application Priority Data

Dec. 24, 2008 (KR) ..... 10-2008-0133977

(51) Int. Cl.
*D06F 37/00* (2006.01)
*B08B 3/12* (2006.01)
*F26B 3/00* (2006.01)

(52) U.S. Cl.
USPC ..... 68/5 C; 68/5 R; 34/443

(58) Field of Classification Search
USPC ..... 68/5 C, 5 R; 34/443
See application file for complete search history.

(56) References Cited

U.S. PATENT DOCUMENTS

| | | | | |
|---|---|---|---|---|
| 5,680,810 | A * | 10/1997 | Sham | 99/330 |
| 2006/0101588 | A1 | 5/2006 | Park et al. | |
| 2006/0191915 | A1* | 8/2006 | Kanzaki et al. | 219/682 |
| 2007/0151129 | A1* | 7/2007 | McAllister et al. | 38/3 |
| 2008/0000098 | A1* | 1/2008 | Choi et al. | 34/114 |
| 2008/0115292 | A1 | 5/2008 | Park et al. | |
| 2008/0168805 | A1 | 7/2008 | Kim et al. | |
| 2008/0295546 | A1* | 12/2008 | Cho et al. | 68/17 R |

FOREIGN PATENT DOCUMENTS

| | | | |
|---|---|---|---|
| JP | 2006-141986 | | 6/2006 |
| KR | 10-2006-0120827 | A | 11/2006 |
| KR | 10-2007-0041222 | A | 4/2007 |

* cited by examiner

*Primary Examiner* — Michael Barr
*Assistant Examiner* — Charles W Kling
(74) *Attorney, Agent, or Firm* — Birch, Stewart, Kolasch & Birch, LLP

(57) ABSTRACT

Disclosed is a clothes treating apparatus with a liquid supply unit. The clothes treating apparatus comprises: a body; a drum accommodated in the body; a steam generator communicated with inside of the drum, and configured to inject steam into the drum; a reservoir configured to store liquid to be supplied to the steam generator, and having an outlet at a bottom surface thereof; a closure having a check valve, and configured to close the outlet; and a reservoir accommodation portion configured to temporarily store the liquid discharged through the check valve, and communicated with the steam generator for flow of the liquid, wherein the check valve is configured to be open only when the reservoir has been mounted to the reservoir accommodation portion.

6 Claims, 2 Drawing Sheets

CLOTHES TREATING APPARATUS WITH LIQUID SUPPLY UNIT

TECHNICAL FIELD

The present invention relates to a clothes treating apparatus, and particularly, to a clothes treating apparatus capable of being used to wash or dry clothes, such as a clothes dryer, and capable of spraying liquid into the clothes during a clothes treating process.

BACKGROUND ART

A clothes treating apparatus such as a clothes dryer or a washing machine having a drying function serves to dry clothes by accommodating clothes into a drum installed in a body, and by supplying blast into the drum. Here, the blast of a high temperature is supplied into the drum to remove moisture of the clothes in a state that the clothes having been completely dehydrated are disposed in the drum. This may cause the clothes tangled with each other to be dried with a lot of wrinkles.

To solve this, there has been proposed a clothes dryer capable of removing wrinkles by supplying steam to clothes having been completely dried.

According to the clothes dryer having a steam supply device, excessive wrinkles may be removed by making the clothes contain a proper amount of moisture by supplying steam to the clothes during a drying process. And, the clothes having been drawn out of the clothes dryer may be in a state suitable for ironing.

The steam supply device of the clothes dryer includes a steam generator having a heater therein, a pump for supplying water into the steam generator, a reservoir for storing water to be supplied into the steam generator, etc. The steam generator is therein provided with a high level sensor and a low level sensor each for sensing a level of supplied water. The pump is operated by a controller based on the water level sensed by the sensors, thereby allowing the steam generator to maintain a water level inside a proper range.

The conventional steam supply device may have the following problems.

Firstly, the conventional steam supply device a complicated structure due to the plurality of components, and have high fabrication costs due to the expensive pump.

Secondly, water leakage may occur at a connection part between the reservoir and the pump.

Thirdly, once water shortage is detected while the steam generator operates, an inner temperature of the steam supply device becomes lower due to a large amount of water which is additionally supplied. This may cause steam generation to be paused.

DISCLOSURE OF INVENTION

Technical Problem

Therefore, an object of the present invention is to provide a clothes treating apparatus with a liquid supply unit capable of supplying a proper amount of liquid into a steam generator without using an expensive pump.

Solution to Problem

To achieve these and other advantages and in accordance with the purpose of the present invention, as embodied and broadly described herein, there is provided a clothes treating apparatus, comprising: a body; a drum accommodated in the body; a steam generator communicated with inside of the drum, and configured to inject steam into the drum; a reservoir configured to store liquid to be supplied to the steam generator, and having an outlet at a bottom surface thereof; a closure having a check valve, and configured to close the outlet; and a reservoir accommodation portion configured to temporarily store the liquid discharged through the check valve, and communicated with the steam generator for flow of the liquid, wherein the check valve is configured to be open only when the reservoir has been mounted to the reservoir accommodation portion.

The liquid inside the reservoir may be consecutively supplied into the steam generator by an amount consumed by the steam generator, by making a pressure of the liquid and air inside the reservoir equal to the atmospheric pressure, without using the conventional pump. When a pressure of the liquid and air inside the reservoir is equal to an atmospheric pressure, a level of the liquid inside the reservoir accommodation portion to which the reservoir has been mounted may be equal to a height of the check valve.

Accordingly, a position of the check valve when the reservoir has been mounted to the reservoir accommodation portion may be set to be higher than an upper surface of the steam generator. This may allow the steam generator to always maintain a full water level.

The steam generator may include a container, and a heater installed in the container. In this case, the position of the check valve when the reservoir has been mounted to the reservoir accommodation portion may be set to be higher than the heater. Through this configuration, the heater may be always in an immersed state into the liquid. This may prevent heat from the heater from being directly transmitted to the container, thereby protecting the heater and the container.

Alternatively, the position of the check valve may be set to be higher than the heater, but to be lower than an upper surface of the container, thereby allowing the steam generator to always maintain a proper water level.

The clothes treating apparatus may further comprise a conduit configured to connect the reservoir accommodation portion and the steam generator with each other.

The clothes treating apparatus may further comprise an inlet formed above the reservoir, and a supplementary closure configured to open and close the inlet. The liquid may be supplemented into the reservoir through the inlet.

An adjustment panel configured to adjust the clothes treating apparatus may be protrudingly formed on an upper surface of the body, and the reservoir may constitute a part of the adjustment panel. In this case, the reservoir may be configured to be flushed with the adjustment panel.

The reservoir may be partially or entirely made of a transparent material, such that a remaining amount of the liquid inside the reservoir is easily checked. The transparent material may indicate a material having transparency high enough to check a level of the liquid inside the reservoir.

According to another aspect of the present invention, there is provided a clothes treating apparatus, comprising: a body; a drum accommodated in the body; a steam generator communicated with inside of the drum, and configured to inject steam into the drum; a reservoir configured to store liquid to be supplied to the steam generator, having an outlet at a bottom surface thereof, and installed at the steam generator; and a closure having a check valve, and configured to close the outlet, wherein the check valve is configured to be open only when the reservoir has been mounted to the steam generator.

Advantageous Effects of Invention

According to the aspects of the present invention, the clothes treating apparatus may have a simple structure since the reservoir is directly installed at the steam generator.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings.

MODE FOR THE INVENTION

Description will now be given in detail of the present invention, with reference to the accompanying drawings.

Figure 1:
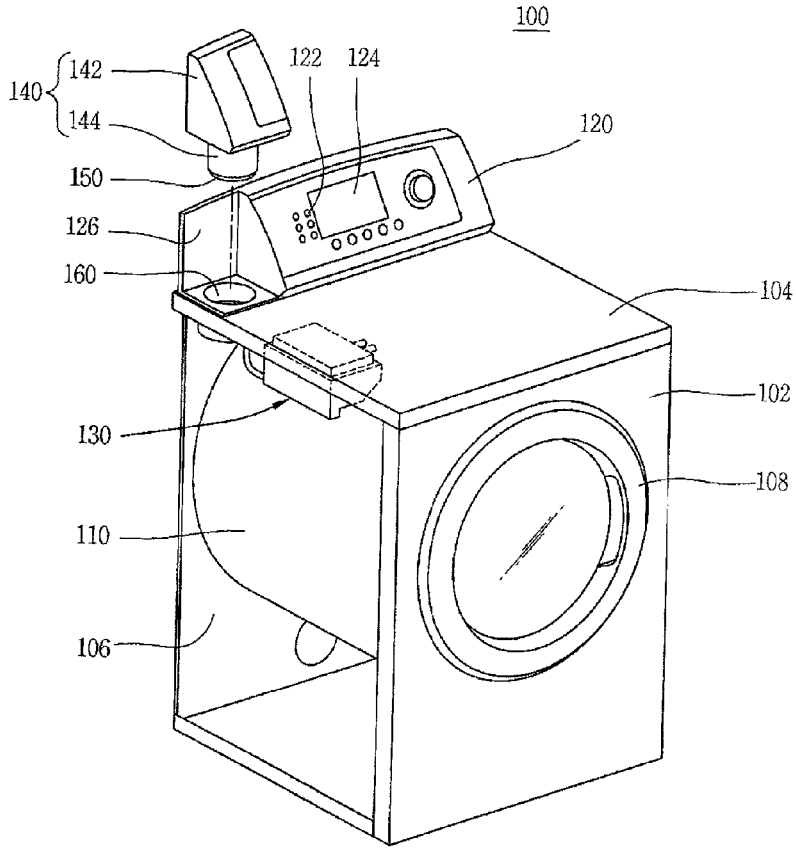
FIG. 1 is a perspective view schematically showing a clothes treating apparatus according to a first embodiment of the present invention.
Figure 2:
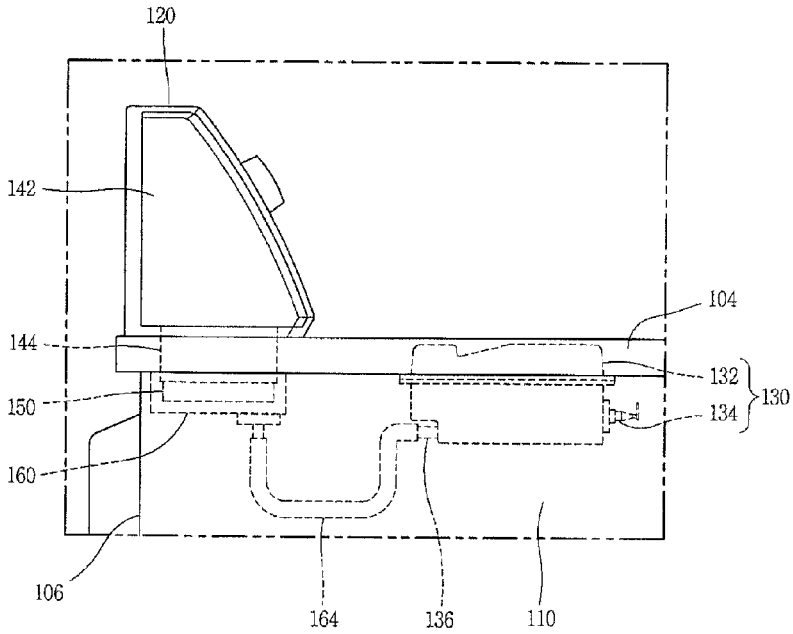
FIG. 2 is a side sectional view showing a position relation between a reservoir and a steam generator of FIG. 1.

FIG. 1 is a perspective view schematically showing a clothes treating apparatus according to a first embodiment of the present invention, and FIG. 2 is a side sectional view showing a position relation between a reservoir and a steam generator of FIG. 1.

In the preferred embodiment, the clothes treating apparatus according to the present invention is applied to a clothes dryer 100 having a stream spraying function. However, the clothes treating apparatus according to the present invention is not limited to the clothes dryer 100, but may be applied to a washing machine having a clothes drying function, etc.

Referring to FIGS. 1 and 2, the clothes dryer 100 comprises a front plate 102 which forms a front surface of the clothes dryer 100, a top plate 104 which forms an upper surface of the clothes dryer 100, a rear plate 106 which forms a rear surface of the clothes dryer 100, a side plate which forms a side surface of the clothes dryer 100, etc. For convenience, the side plate was omitted in drawings.

A circular door 108 is installed at a central part of the front plate 104, and a user is accessible, through the door 108, to inside of a drum (not shown) rotatably installed in the body. More concretely, the drum serves to accommodate clothes therein, and installed in a tub 110 concentrically installed outside the drum.

The clothes dryer 100 comprises a blast path configured to form a flow path of blast supplied into the drum, and installed at the rear plate; a heater installed inside the blast path, and forming blast by heating introduced air; a blower fan configured to transfer the blast along the blast path; etc. Accordingly, the blast is supplied to a front side of the drum from a rear side of the drum during a drying process. This configuration may be implemented by adopting the conventional technique, and thus its detailed explanations will be omitted.

An adjustment panel 120 is protruding from a rear surface of the top plate 104. Each kind of switch 122 for controlling the operation of the clothes treating apparatus, a display window 124, etc. are provided on the surface of the adjustment panel 120.

A steam generator 130 is installed on a bottom surface of the top plate 104. The steam generator 130 includes a container 132 which forms a space where water to be heated is stored; and a heater 134 installed adjacent to a bottom surface of the container 132, and configured to heat the stored water. An inlet 136 is formed at one side of the bottom surface of the container 132, through which water is introduced into the container 132 from a reservoir which will be later explained. The inlet 136 may be positioned on an upper surface of the container 132, not on the bottom surface of the container 132.

A reservoir 140 configured to store water to be supplied to the steam generator 130 is positioned at one side of the adjustment panel 120. The reservoir 140 includes a storage portion 142, and an outlet 144 formed on a bottom surface of the reservoir 142. The storage portion 142 is formed of a material having transparency high enough for a remaining amount of water inside the reservoir 140 to be seen from outside. A closure 150 having a check valve installed thereat is mounted to the outlet 144.

The reservoir 140 is installed at a reservoir accommodation portion 126 disposed at one side of the adjustment panel 120. In this state, a front surface of the reservoir 140 is consecutively connected to a front surface of the adjustment panel 120. This may provide an integrated appearance of the reservoir 140 and the adjustment panel 120. The reservoir 140 may be installed at a position separated from the adjustment panel 120. In a case that the adjustment panel 120 is positioned on the same plane as the top plate, rather than the case that the adjustment panel 120 is protruding from the top plate, the reservoir 140 may be independently positioned from the adjustment panel 120. In this case, the reservoir 140 may be positioned on a bottom surface of the top plate not to be exposed to the outside.

A supplementary reservoir 160 is formed on a bottom surface of the reservoir accommodation portion 126. The supplementary reservoir 160 serves to provide a space which encompasses an outer circumference of the outlet in a state that the reservoir has been mounted to the reservoir accommodation portion. And, the supplementary reservoir 160 also serves to temporarily store water discharged through the outlet 144 before the water is supplied to the steam generator.

An outlet 162 is formed on a bottom surface of the supplementary reservoir 160. And, the outlet 162 and the inlet 136 of the steam generator 130 are connected to each other such that liquid flows through a conduit 164 therebetween.

As shown in FIG. 2, the steam generator is installed such that the heater 134 disposed in the container 132 is positioned at a lower side of the closure 150. Among an upper surface of the container 130 of the steam generator, a part having a lowest height is positioned at an upper side of the closure 150. The reason is because water supplied into the steam generator has the same height as the closure 150, more concretely, the check valve of the closure 150. This may allow a water level inside the container 132 of the steam generator to be always in an optimum state, i.e., to be positioned between the heater 134 and the upper surface of the container 130 of the steam generator.

The embodiment will be explained in more detail with reference to FIG. 3.

Figure 3:
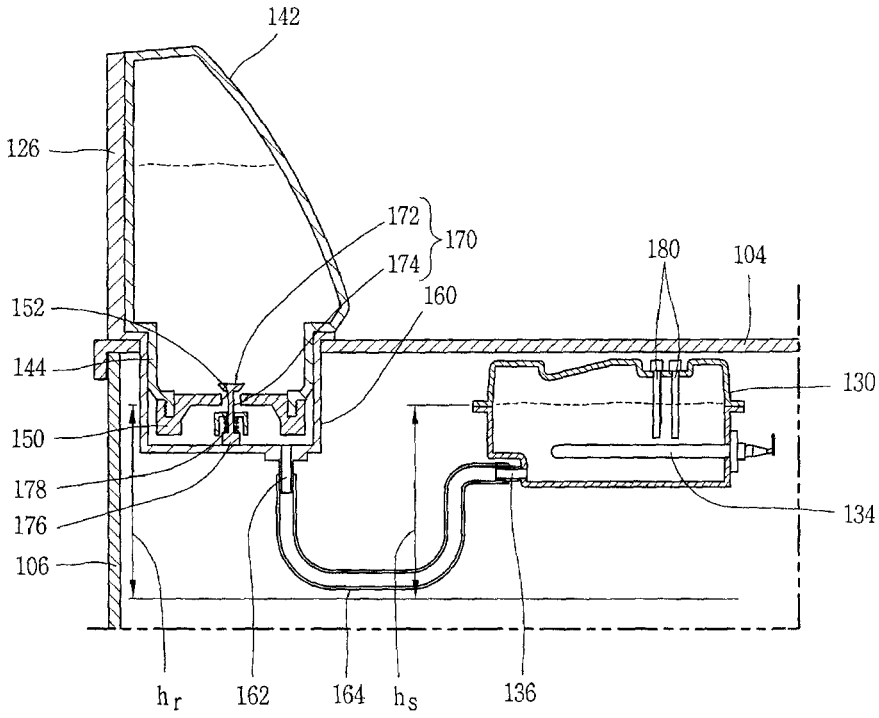
FIG. 3 is a sectional view schematically showing a sectional surface of the clothes treating apparatus corresponding to the side sectional view of FIG. 2.

FIG. 3 is a sectional view schematically showing a sectional surface of the clothes treating apparatus corresponding to the side sectional view of FIG. 2.

Referring to FIG. 3, a valve hole 152 is formed at a central part of the closure 150, and a valve body 170 configured to open and close the valve hole 152 is mounted to the valve hole 152 so as to be movable in upper and lower directions. The valve body 170 consists of a head 172 configured to open and close the valve hole 152, and a stem 174 protrudingly-extending from the head 172.

A mounting portion 176 contacting a bottom surface of the supplementary reservoir 160 is formed at the end of the stem 174, and a coil spring 178 is installed on the mounting portion 176. The coil spring 178 serves to provide an elastic force to the valve body 170. When the reservoir 140 is in a separated state from the reservoir accommodation portion 126, water inside the reservoir 140 does not leak to outside since the valve hole 152 is closed by the head 172 by the coil spring 178. On the other hand, when the reservoir 140 is in a mounted state to the reservoir accommodation portion 126, the mounting portion 176 is pressed by a bottom surface of the supplementary reservoir 160. Accordingly, the head 172 is upwardly moved to open the valve hole 152, and thus the water inside the reservoir 140 is discharged to be stored in the supplementary reservoir 160.

Then, the water stored in the supplementary reservoir 160 is introduced into the container 132 of the steam generator through the conduit 164.

The operation of the clothes treating apparatus will be explained with reference to FIG. 3.

As aforementioned, when the reservoir 140 is in a mounted state to the reservoir accommodation portion 126, the mounting portion 176 is pressed by a bottom surface of the supplementary reservoir 160. Accordingly, the head 172 is upwardly moved to open the valve hole 152, and thus the water inside the reservoir 140 is discharged to be stored in the supplementary reservoir 160. Once a water level ($h_s$) inside the steam generator becomes low due to steam generation, the water inside the supplementary reservoir 160 is introduced into the steam generator through the conduit 164. Accordingly, a water level ($h_r$) inside the supplementary reservoir 160 becomes low.

Once the water level ($h_r$) inside the supplementary reservoir 160 becomes lower than the height of the valve hole 152, external air is introduced into the reservoir 140 through the valve hole 152 due to the atmospheric pressure. Since the introduced external air pushes out the water inside the reservoir 140, the water level ($h_r$) inside the supplementary reservoir 160 becomes high. Once the water level ($h_r$) inside the supplementary reservoir 160 becomes high enough to reach the valve hole 152, introduction of external air into the reservoir 140 is prevented, and thus the increase of the water level ($h_r$) inside the supplementary reservoir 160 is stopped. Through these processes, the water level ($h_s$) inside the steam generator becomes equal to the water level ($h_r$) inside the supplementary reservoir 160.

In the case that the amount of water inside the reservoir 140 is small, the amount of water to be introduced into the steam generator is reduced. This may cause the water level ($h_s$) inside the steam generator to become gradually low. Accordingly, a low level sensor composed of two electrodes is installed in the steam generator. If the water level inside the steam generator becomes low enough for the heater to be exposed out, a warning signal is sent to a user so as to stop the heater for protection of the clothes treating apparatus. The low level sensor may be installed at the conventional steam generator, together with a high level sensor configured to sense a full water level. However, in the present invention, a high level sensor may be omitted since the steam generator does not have a full water level.

The preferred embodiment of the present invention may be implemented in various manners. For instance, the inlet which is open and closed by the closure may be formed above the reservoir 140, thereby re-supplying water to the reservoir 140 even in a state that the reservoir 140 has been mounted to the reservoir accommodation portion 160. This may enhance the user s convenience. Here, water has to be resupplied to the reservoir 140 only when water shortage has been detected by the low level sensor. The reason is as follows. If the closure on the reservoir is opened in a state that water remains in the reservoir, the remaining water may be discharged out at one time due to the atmospheric pressure applied into the reservoir.

Furthermore, the reservoir may be directly installed at the container of the steam generator, without installing the supplementary reservoir. The liquid to be stored in the reservoir is not limited to water, but may include various types of liquid to be sprayed to clothes in the form of steam, e.g., fragrant liquid.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

The invention claimed is:

1. A clothes treating apparatus, comprising:

a body;

a drum accommodated in the body;

a steam generator communicated with inside of the drum, and configured to inject steam into the drum;

a reservoir configured to store liquid to be supplied to the steam generator, and having an outlet at a bottom surface thereof;

a closure having a check valve, and configured to close the outlet; and a reservoir accommodation portion configured to temporarily store the liquid discharged through the check valve, laterally spaced from the steam generator;

a conduit configured to connect the reservoir accommodation portion and the steam generator;

wherein the steam generator comprises:

a container; and a heater installed in the container, wherein a position of the check valve when the reservoir has been mounted to the reservoir accommodation portion is set to be higher than the heater, and wherein the check valve is configured to be open only when the reservoir has been mounted to the reservoir accommodation portion and to allow introduction of outside air into the reservoir via the outlet to increase a water level of the reservoir accommodation portion to the level of the check valve.

2. The clothes treating apparatus of claim 1, wherein a position of the check valve is set to be higher than the heater, but to be lower than an upper surface of the container.

3. The clothes treating apparatus of claim 1, further comprising:

an inlet formed above the reservoir; and a supplementary closure configured to open and close the inlet.

4. The clothes treating apparatus of claim 1, wherein an adjustment panel configured to adjust the clothes treating apparatus is protrudingly formed on an upper surface of the body, and wherein the reservoir constitutes a part of the adjustment panel.

5. The clothes treating apparatus of claim 4, wherein the reservoir is configured to be flush with the adjustment panel.

6. The clothes treating apparatus of claim 1, wherein the reservoir is partially or entirely made of a transparent material.

* * * * *